US008776873B2

(12) United States Patent
Mross et al.

(10) Patent No.: US 8,776,873 B2
(45) Date of Patent: Jul. 15, 2014

(54) HEAT EXCHANGER

(75) Inventors: Greg Mross, Sturtevant, WI (US); Brad Engel, Waterford, WI (US); Mark Johnson, Racine, WI (US); Michael Reinke, Franklin, WI (US)

(73) Assignee: Modine Manufacturing Company, Racine, WI (US)

( * ) Notice: Subject to any disclaimer, the term of this patent is extended or adjusted under 35 U.S.C. 154(b) by 548 days.

(21) Appl. No.: 13/076,607

(22) Filed: Mar. 31, 2011

(65) Prior Publication Data

US 2011/0240271 A1 Oct. 6, 2011

Related U.S. Application Data

(60) Provisional application No. 61/319,733, filed on Mar. 31, 2010.

(51) Int. Cl.
*F28F 9/02* (2006.01)
*F28F 9/24* (2006.01)

(52) U.S. Cl.
USPC ..... 165/176; 165/173

(58) Field of Classification Search
CPC ..... F28F 9/0221; F28F 9/0224; F28F 9/0229
USPC ..... 165/173, 174, 175, 176, 153
See application file for complete search history.

(56) References Cited

U.S. PATENT DOCUMENTS 5,000,257 A 3/1991 Shinmura
5,000,681 A 3/1991 Zafred et al.
5,035,052 A 7/1991 Suzuki et al.
5,036,909 A 8/1991 Whitehead et al.
5,086,835 A 2/1992 Shinmura
5,314,013 A 5/1994 Tanabe
5,327,959 A * 7/1994 Saperstein et al. ..... 165/173
5,370,176 A 12/1994 Nishishita et al.

(Continued)

FOREIGN PATENT DOCUMENTS

DE 102007016050 10/2007
EP 1298401 4/2003
WO 2005088225 9/2005

OTHER PUBLICATIONS

Office Action from the United States Patent and Trademark Office for U.S. Appl. No. 29/390,394 dated Feb. 10, 2014 (7 pages).

(Continued)

*Primary Examiner* — Tho V Duong
(74) *Attorney, Agent, or Firm* — Michael Best & Friedrich LLP

(57) ABSTRACT

A heat exchanger including a first header, a second header, and a third header. The third header includes a first plate including a generally planar face and a second plate including a generally planar face parallel to the planar face of the first plate and joined to the planar face of the first plate. The second plate includes an arcuate recess that extends from the planar face of the second plate to at least partially define a flow conduit between a first tube and a second tube. The arcuate recess has a radius of curvature measured from an axis generally parallel to the planar faces of the first and the second plates, and the axis is located within a first plane generally parallel to and midway between first and second opposing flat broad sides of the first tube and the second tube.

14 Claims, 13 Drawing Sheets

(56) References Cited

U.S. PATENT DOCUMENTS

| | | | | |
|---|---|---|---|---|
| 5,426,847 | A | 6/1995 | Honma et al. | |
| 5,467,818 | A | 11/1995 | Buckley, Jr. | |
| 5,529,116 | A | 6/1996 | Sasaki et al. | |
| 5,605,191 | A | 2/1997 | Eto et al. | |
| RE35,710 | E | 1/1998 | Shinmura | |
| 5,743,328 | A | 4/1998 | Sasaki et al. | |
| 5,787,973 | A | 8/1998 | Kado et al. | |
| 6,161,616 | A | 12/2000 | Haussmann | |
| 6,460,610 | B2 | 10/2002 | Lambert et al. | |
| 6,749,015 | B2 * | 6/2004 | Moreau | 165/174 |
| 6,814,136 | B2 | 11/2004 | Yi et al. | |
| 6,827,139 | B2 * | 12/2004 | Kawakubo et al. | 165/173 |
| 6,988,544 | B2 | 1/2006 | Ozaki et al. | |
| 7,044,208 | B2 * | 5/2006 | Kawakubo et al. | 165/173 |
| 7,143,512 | B2 | 12/2006 | Kroetsch et al. | |
| 7,293,604 | B2 | 11/2007 | Sasaki et al. | |
| 7,426,958 | B2 | 9/2008 | Yu | |
| 7,481,266 | B2 | 1/2009 | Demuth et al. | |
| 7,607,473 | B2 * | 10/2009 | Ichiyanagi | 165/173 |
| 7,637,314 | B2 | 12/2009 | Park et al. | |
| 7,650,935 | B2 | 1/2010 | Demuth et al. | |
| 7,798,206 | B2 | 9/2010 | Hirano et al. | |
| 7,832,463 | B2 | 11/2010 | Bergmiller et al. | |
| 8,100,171 | B2 | 1/2012 | Zebuhr | |
| 8,181,694 | B2 | 5/2012 | Powers et al. | |
| 8,196,646 | B2 | 6/2012 | Huang et al. | |
| 8,235,099 | B2 | 8/2012 | Higashiyama | |
| 8,261,567 | B2 | 9/2012 | Zangari et al. | |
| 8,296,948 | B2 | 10/2012 | Lesage | |
| 8,322,407 | B2 | 12/2012 | Reynolds | |
| 8,353,330 | B2 | 1/2013 | Lim et al. | |
| 8,371,366 | B2 | 2/2013 | Higashiyama et al. | |
| 8,561,678 | B2 | 10/2013 | Richardson et al. | |
| 8,590,607 | B2 | 11/2013 | Demuth et al. | |
| 2003/0221819 | A1 | 12/2003 | Jang | |
| 2005/0039901 | A1 | 2/2005 | Demuth et al. | |
| 2005/0103486 | A1 | 5/2005 | Demuth et al. | |
| 2005/0217838 | A1 | 10/2005 | Katoh et al. | |
| 2006/0086486 | A1 | 4/2006 | Sudo | |
| 2006/0162917 | A1 * | 7/2006 | Park et al. | 165/175 |
| 2007/0131391 | A1 | 6/2007 | Ichiyanagi | |
| 2007/0251682 | A1 | 11/2007 | Sasaki | |
| 2009/0236086 | A1 | 9/2009 | Higashiyama et al. | |
| 2009/0314475 | A1 | 12/2009 | Jeon et al. | |
| 2010/0147498 | A1 | 6/2010 | Huang et al. | |
| 2010/0319379 | A1 | 12/2010 | Zangari et al. | |
| 2011/0192582 | A1 | 8/2011 | Knight et al. | |
| 2013/0199760 | A1 | 8/2013 | Kadle et al. | |

OTHER PUBLICATIONS

Extended European Search Report from the European Patent Office for European Application No. 11002633.3 dated Feb. 28, 2014 (8 pages).

First Chinese Office Action for Chinese Application No. 201110083129.X dated Apr. 8, 2014 (19 pages).

* cited by examiner

HEAT EXCHANGER

CROSS REFERENCE TO RELATED APPLICATIONS

This application claims priority to U.S. Provisional Patent Application No. 61/319,733, filed Mar. 31, 2010, the entire contents of which are hereby incorporated by reference herein.

BACKGROUND

The present application relates to heat exchangers.

Vapor compression systems are commonly used for refrigeration and/or air conditioning and/or heating, among other uses. In a typical vapor compression system, a refrigerant, sometimes referred to as a working fluid, is circulated through a continuous thermodynamic cycle in order to transfer heat energy to or from a temperature and/or humidity controlled environment and from or to an uncontrolled ambient environment. While such vapor compression systems can vary in their implementation, they most often include at least one heat exchanger operating as an evaporator, and at least one other heat exchanger operating as a condenser.

In systems of the aforementioned kind, a refrigerant typically enters an evaporator at a thermodynamic state (i.e., a pressure and enthalpy condition) in which it is a subcooled liquid or a partially vaporized two-phase fluid of relatively low vapor quality. Thermal energy is directed into the refrigerant as it travels through the evaporator, so that the refrigerant exits the evaporator as either a partially vaporized two-phase fluid of relatively high vapor quality or a superheated vapor.

At another point in the system the refrigerant enters a condenser as a superheated vapor, typically at a higher pressure than the operating pressure of the evaporator. Thermal energy is rejected from the refrigerant as it travels through the condenser, so that the refrigerant exits the condenser in an at least partially condensed condition. Most often the refrigerant exits the condenser as a fully condensed, subcooled liquid.

Some vapor compression systems are reversing heat pump systems, capable of operating in either an air conditioning mode (such as when the temperature of the uncontrolled ambient environment is greater than the desired temperature of the controlled environment) or a heat pump mode (such as when the temperature of the uncontrolled ambient environment is less than the desired temperature of the controlled environment). Such a system may require heat exchangers that are capable of operating as an evaporator in one mode and as a condenser in an other mode.

SUMMARY

Some embodiments of the invention provide a heat exchanger including first and second sequential flow passes for a fluid, and a header structure to fluidly connect the first and second sequential flow passes. The first flow pass comprises a first plurality of parallel arranged tubes, each having two opposing broad flat sides joined by two opposing narrow sides. The second flow pass comprises a second plurality of parallel arranged tubes, each having two opposing broad flat sides joined by two opposing narrow sides. The header structure comprises a first plate having a first planar face approximately perpendicular to the opposing broad flat sides of the first and second plurality of parallel arranged tubes and a second plate having a second planar face parallel to and joined to the first planar face. The first and second plates together define a flow conduit between a first one tube of the first flow pass and a second one tube of the second flow pass. The flow conduit is at least partially defined by an arcuate profile in one of the first and second plates, the arcuate profile defining an axis substantially parallel to the first and second planar faces.

In some embodiments the axis is located within a plane parallel to and approximately midway between the opposing broad flat sides of at least one of the first one tube and the second one tube. In some embodiments the axis is a first axis, and the flow conduit is further at least partially defined by an arcuate profile in the other of the first and second plates. The arcuate profile in the other of the first and second plates defines a second axis substantially parallel to the first and second planar faces, and may be located within a plane parallel to and approximately midway between the opposing broad flat sides of at least one of the first one tube and the second one tube.

In some embodiments one or more of the axes is located within the plane defined by the first and second planar faces. In some embodiments the first axis may be coincident with the second axis.

Some embodiments of the invention provide a first tube slot in one of the first and second plates to receive an end of the first one tube therein, and provide a second tube slot in one of the first and second plates to receive an end of the one second tube therein. In some embodiments the edges of the first and second tube slots are offset from the first and second planar faces.

In some embodiments the first tube slot includes a tapered lead-in for assembly of the one first tube therein. In some embodiments the second tube slot includes a tapered lead-in for assembly of the one second tube therein.

In some embodiments the edges of one or both of the first and second tube slots are offset from the first and second planar faces by an amount greater than the outer radius of the arcuate profile.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

FIGS. 1-7 illustrate an exemplary embodiment of a heat exchanger 10 according to the present invention. In some applications the heat exchanger 10 may be used as an evaporator in a vapor compression based climate control system. In other applications the heat exchanger 10 may be used as a condenser in a vapor compression based climate control system. In still other applications the heat exchanger 10 may operate both as a condenser in a first mode of operation, and as an evaporator in a second mode of operation. In still other applications the heat exchanger 10 may find utility in other type of systems such as, for example, a Rankine cycle power generation system.

Figure 1:
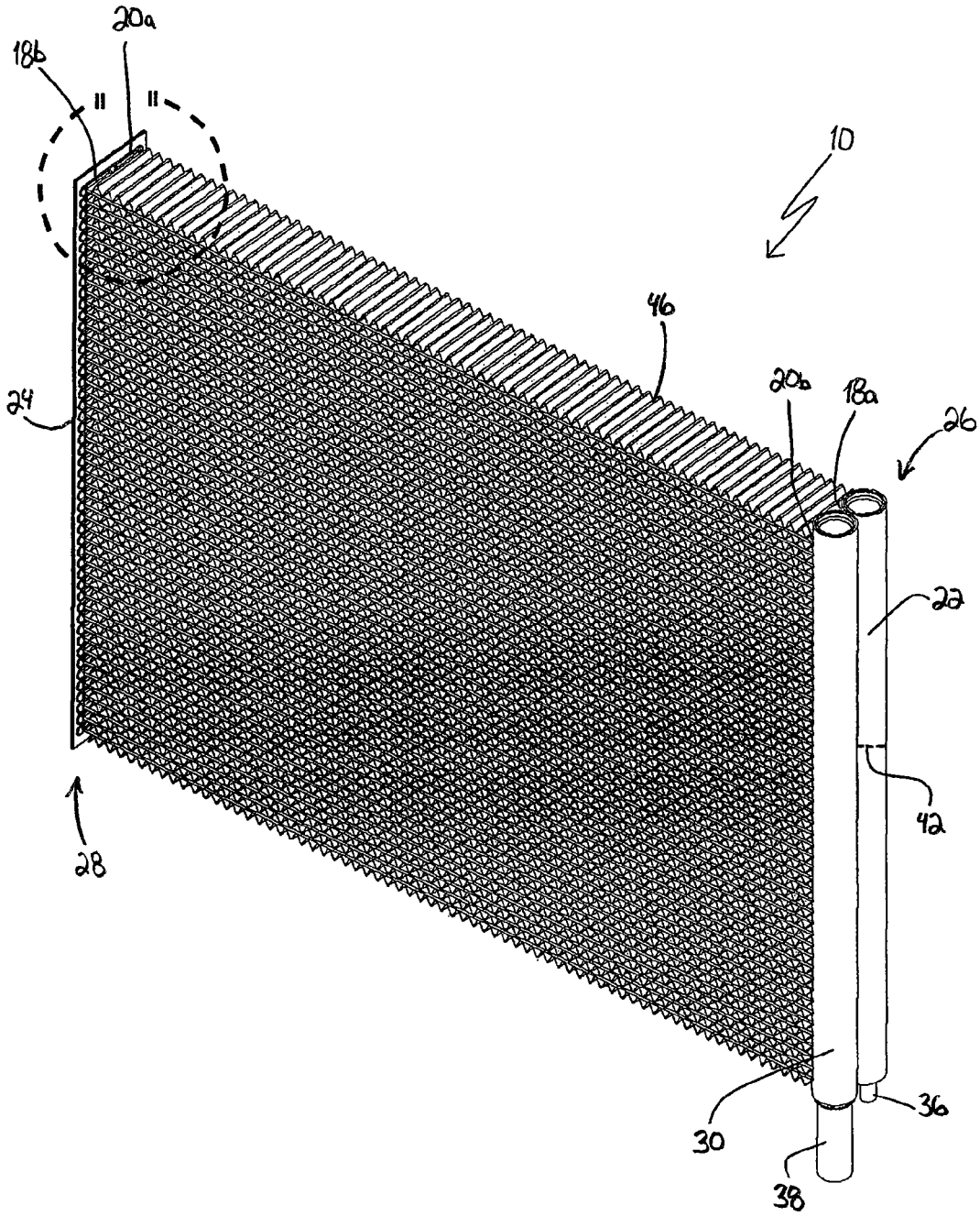
FIG. 1 is a perspective view of a heat exchanger according to an embodiment of the invention.
Figure 2:
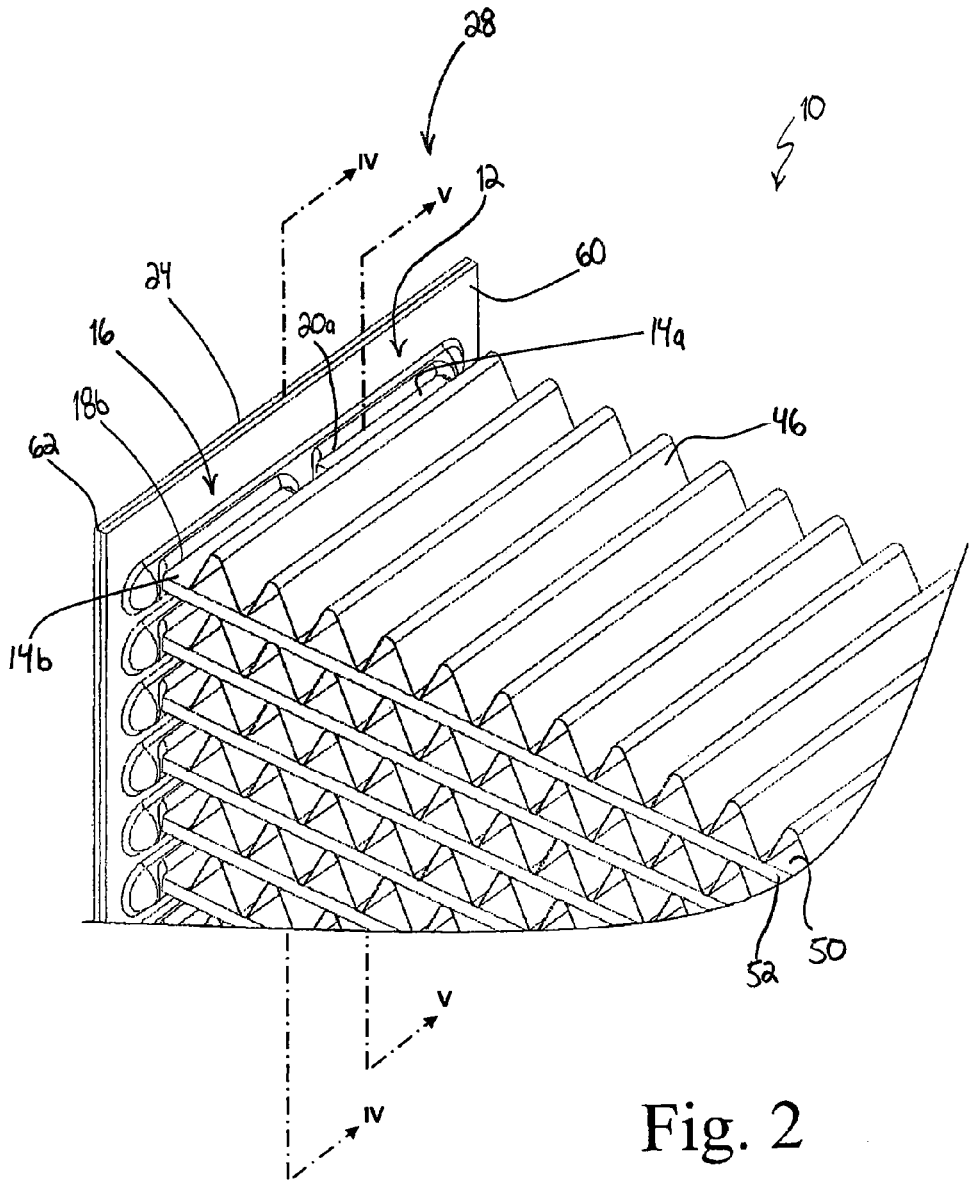
FIG. 2 is a detail view of the portion bounded by the line II-II of FIG. 1.

Referring to FIGS. 1 and 2, the heat exchanger 10 includes a first flow pass 12 comprising a plurality of tubes 14*a* arranged in parallel and a second flow pass 16 comprising a plurality of tubes 14*b* arranged in parallel. The tubes 14*a* of the first flow pass 12 include an inlet end 18*a* and an outlet end 20*a*. The inlet ends 18*a* are adjacent a first header 22, which is tubular in the illustrated embodiment and the outlet ends 20*a* are adjacent a return header 24 such that the tubes 14*a* extend from the first header 22 at a first end 26 of the heat exchanger 10 to the return header 24 at a second end 28 of the heat exchanger 10 opposite the first end 26. The tubes 14*b* of the second flow pass 16 include an inlet end 18*b* and an outlet end 20*b*. The inlets ends 18*b* are adjacent the return header 24 and the outlet ends 20*b* are adjacent a second header 30, which is tubular in the illustrated embodiment, such that the tubes 14*b* extend from the return header 24 to the second header 30, which is located at the first end 26 of the heat exchanger 10. The first header 22 includes a first fluid port 36 that defines an inlet of the heat exchanger 10 and the second header 30 defines a second fluid port 38 that defines an outlet of the heat exchanger 10. The first fluid port 36 and the second fluid port 38 provide a means for connecting the heat exchanger 10 into a system.

In this arrangement, the first and second flow passes 12 and 16 are sequential to one another so that a fluid (for example, a refrigerant) may be directed to flow into the heat exchanger 10 by way of the first fluid port 36, flow through the first flow pass 12 from the first header 22 to the return header 24, flow through the second flow pass 16 from the return header 24 to the second header 30, and flow out of the heat exchanger 10 by way of the second fluid port 38. It should be understood, however, that the fluid might similarly enter the heat exchanger 10 by way of the second fluid port 38 and exit the heat exchanger 10 by way of the first fluid port 36, so that the flow through the heat exchanger 10 is reversed and the fluid encounters the flow passes 12 and 16 in an order that is the reverse of the above.

Referring to FIG. 1, some embodiments of the heat exchanger 10 may include one or more optional baffles 42 in one or both of the headers 22, 30. These baffles 42 serve to separate the internal chamber of the headers 22 and 30 into two or more manifolds. Additional sequential passes for the fluid can thereby be provided for without requiring additional rows of parallel arranged tubes 14*a* or 14*b*.

Referring to FIG. 2, Fins 46 may be arranged between adjacent ones of the tubes 14*a* and 14*b*. Although the exemplary fins 46 are of a serpentine convoluted type, any type of fins regularly used and known in the art can be similarly employed. The fins 46 can be used to provide surface area enhancement and/or flow turbulation in order to improve the rate and extent of heat transfer between the fluid passing through the tubes 14*a*, 14*b* and another fluid, such as for example air, passing over the outer surfaces of the tubes 14*a*, 14*b*. The fins 46 may alternatively or in addition provide beneficial spacing and/or structural support to the tubes 14*a*, 14*b*.

Figure 13:
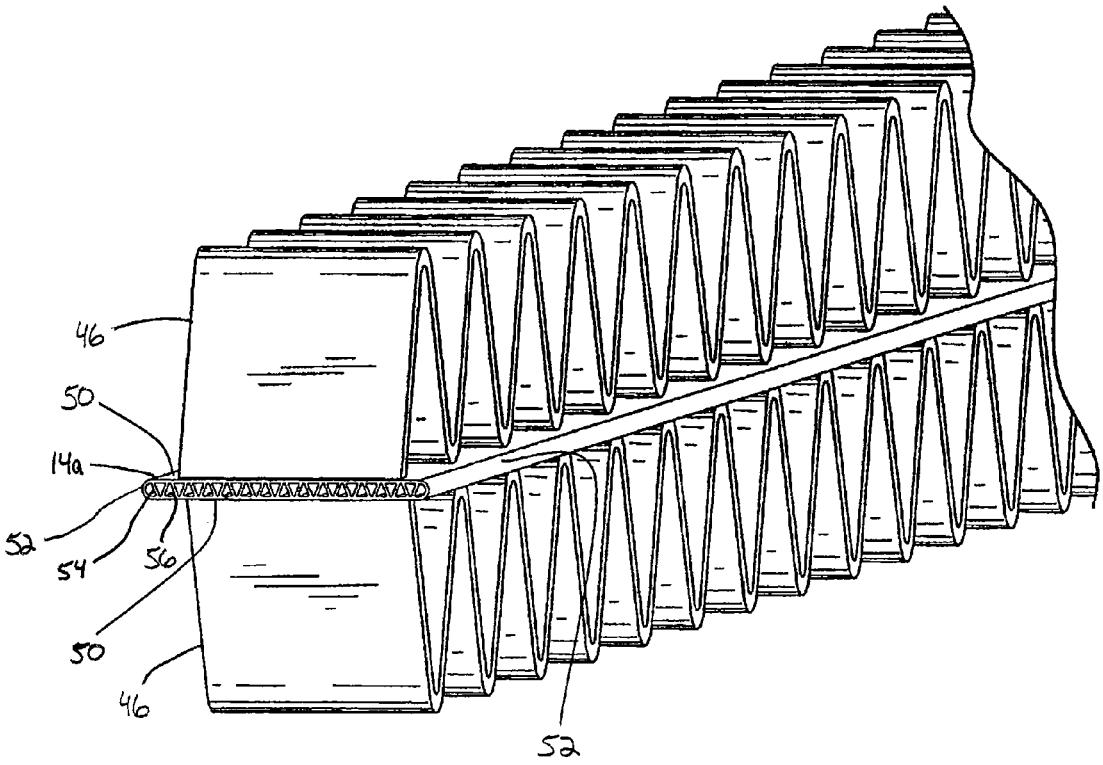
FIG. 13 is a partial perspective view of a tube and fins for use in some embodiments of the invention.

In some embodiments the fins 46 may be of sufficient depth to be common to a tube 14*a* in the first flow pass 12 and a tube 14*b* in the second flow pass 16, as shown in FIG. 2. In other embodiments, such as is shown in FIG. 13, the fins 46 may have a depth that is only sufficient for a single tube 14*a* so that separate fins 46 are used for the tubes 14*a* and the tubes 14*b*. The fins 46 are optional, however, and need not be present at all in a heat exchanger embodying the present invention.

As best seen in FIG. 13, the tubes 14*a*, 14*b* of the exemplary embodiment include two opposing broad flat sides 50 joined by two opposing narrow sides 52. Internal webs 54 may be provided inside the tubes 14*a* and 14*b* in order to divide the internal space of the tube 14*a*, 14*b* into a plurality of internal flow channels 56. The webs 54 may provide heat transfer augmentation as well as structural support for the tube 14*a*, 14*b*. Such structural support may be especially beneficial in vapor compression systems, wherein the fluid passing through the tubes 14*a* and 14*b* may be at an operating pressure that is substantially elevated in comparison to the pressure external to the tubes 14*a* and 14*b*.

Figure 3:
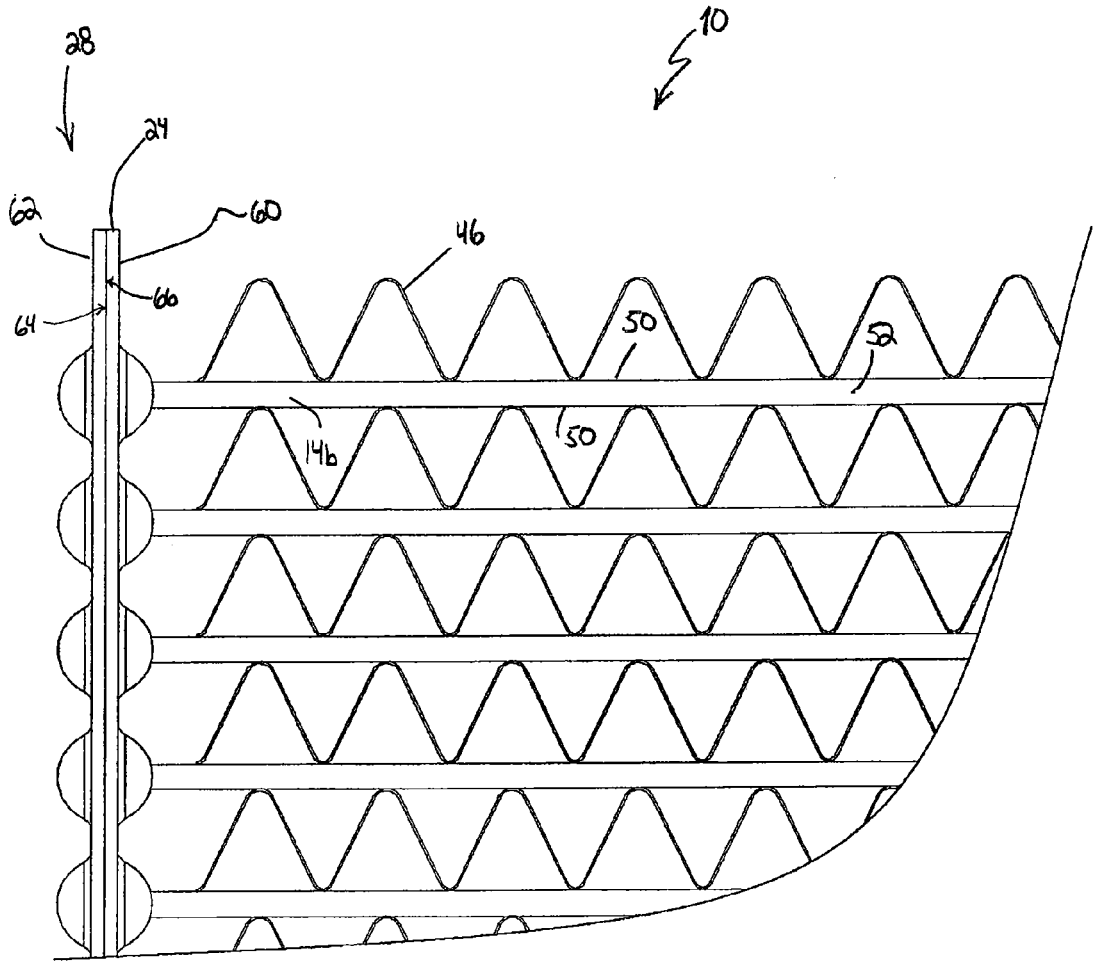
FIG. 3 is a plan view of the portion of the embodiment shown in FIG. 2.
Figure 4:
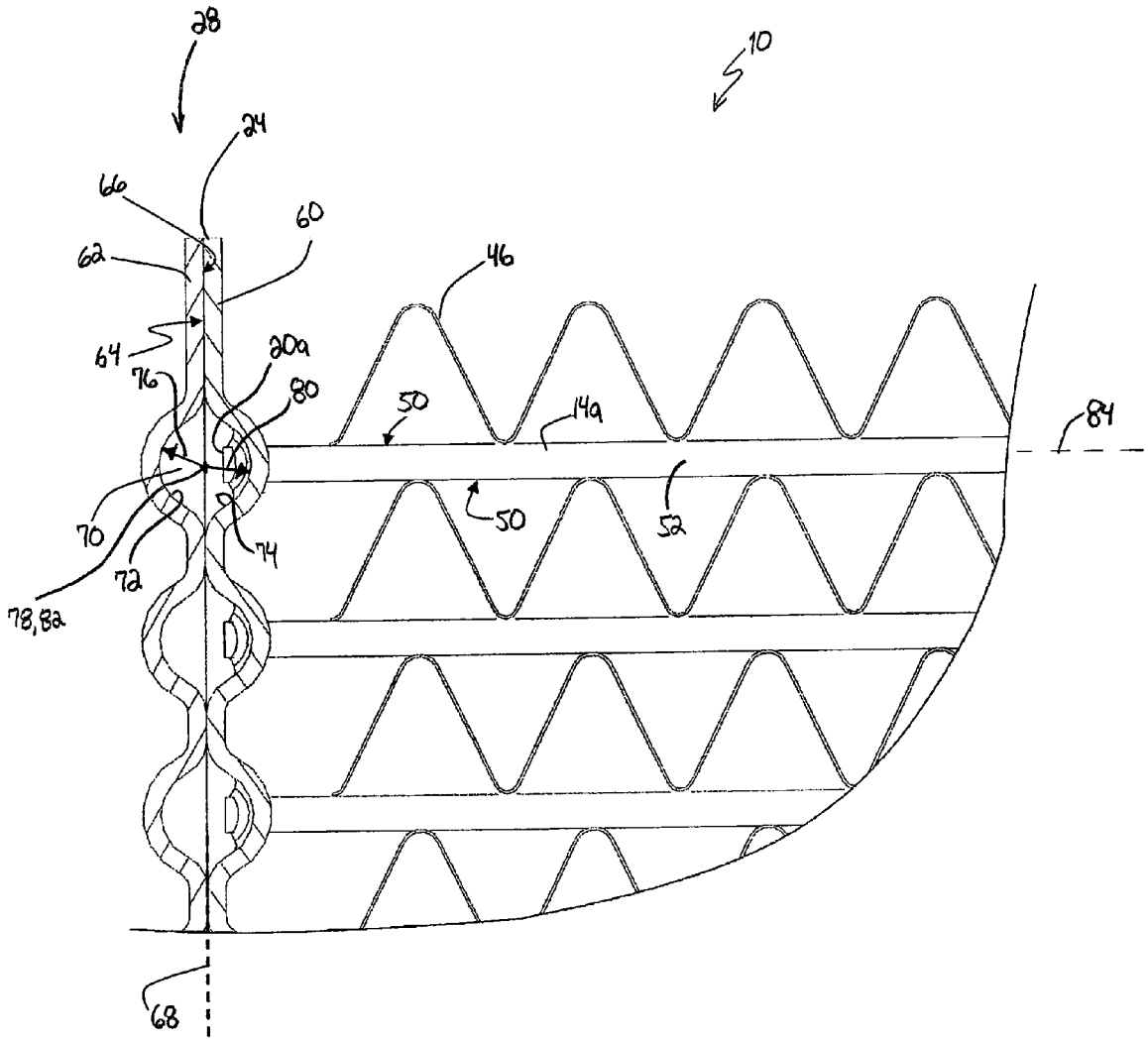
FIG. 4 is a sectional view along the lines IV-IV of FIG. 2.

Referring to FIGS. 2-4, the return header 24 includes a first plate 60 and a second plate 62. A planar face 64 of the first plate 60 is mated to a planar face 66 of the second plate 62. The mated planar faces 64, 66 are located on a plane 68 that is approximately perpendicular to the broad flat sides 50 of the tubes 14*a*, 14*b*.

Together the plate 60 and the plate 62 define a plurality of flow conduits 70, each providing a fluid connection between one of the tubes 14*a* and one of the tubes 14*b*. By connecting the flow passes in this manner, redistribution of a partially vaporized fluid over the multiple tubes 14*b* can be advantageously avoided when the heat exchanger 10 is operating as an evaporator.

In the exemplary embodiment of FIGS. 1-7, a flow conduit 70 is at least partially defined by an arcuate recess 72 that extends from the planar face 66 of the second plate 62 and by an arcuate recess 74 that extends from the planar face 64 of the first plate 60. The arcuate recesses 72 and 74 in one or both of the plates 60 and 62 can provide increased durability to the heat exchanger 10 when functioning at elevated pressures, as may be commonly encountered in both evaporators and condensers, as well as in other heat transfer functions for which the heat exchanger 10 may be utilized.

Figure 5:
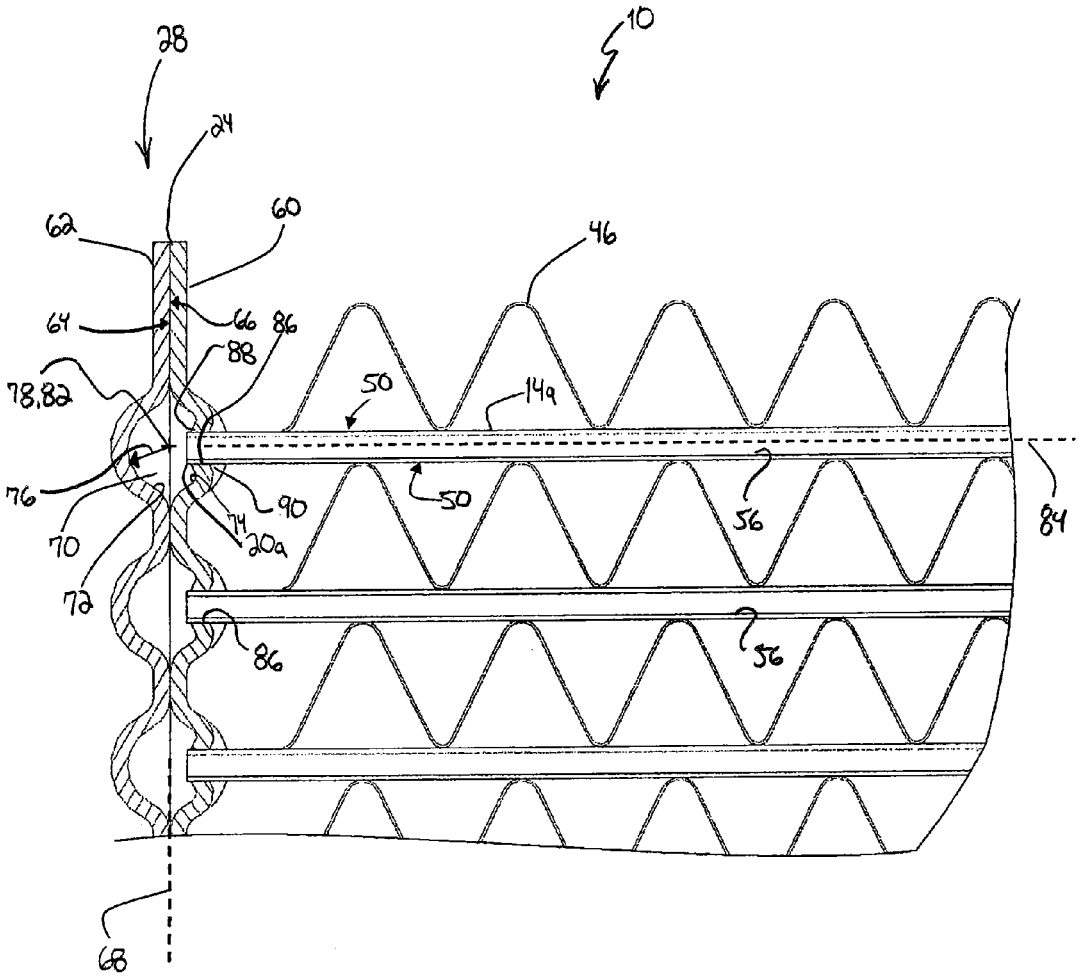
FIG. 5 is a sectional view along the lines V-V of FIG. 2.
Figure 6:
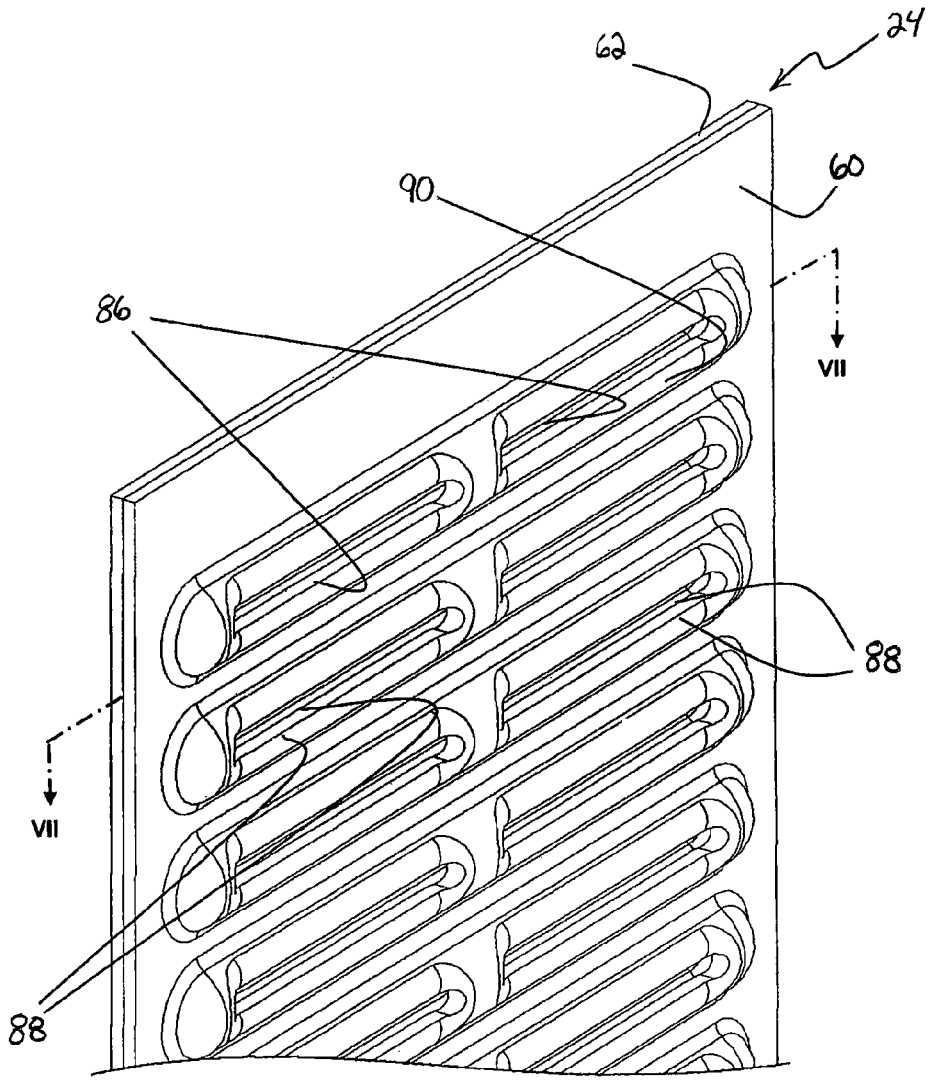
FIG. 6 is a partial perspective view of a header structure of the heat exchanger of FIG. 1.
Figure 7:
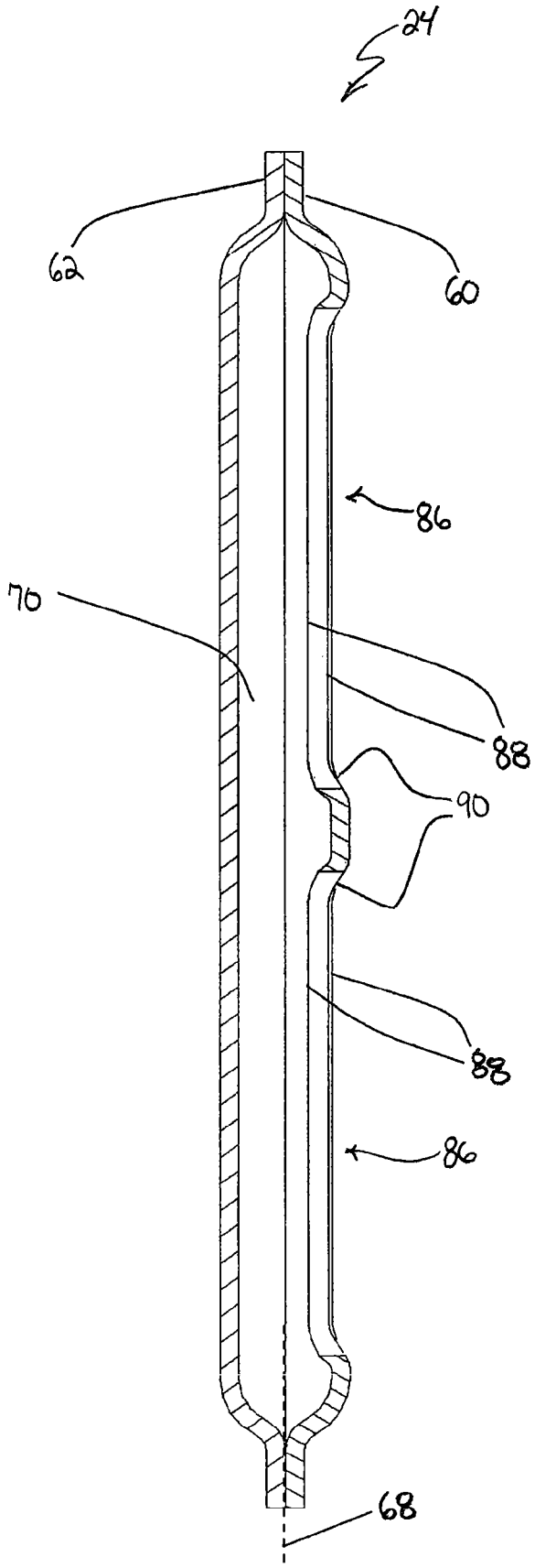
FIG. 7 is a sectional view along the lines VII-VII of FIG. 6.

Continuing with the exemplary embodiment of FIGS. 1-7, the arcuate recess 72 of the second plate 62 has a radius of curvature 76. The radius of curvature 76 is measured about an axis 78 that is generally parallel to the planar faces 64 and 66 of the first plate 60 and the second plate 62, respectively. The arcuate recess 74 of the first plate 60 has a radius of curvature 80 measured about an axis 82 that is generally parallel to the planar faces 64 and 66 of the first plate 60 and the second plate 62, respectively. Both axes 78 and 82 are located in a plane 84 that is parallel to and approximately midway between the opposing broad flat sides 50 of one of the tubes 14*a*, 14*b* that is in fluid communication with the conduit 70. In the illustrated embodiment, the axis 78 and the axis 82 are located within the plane 68, as shown in FIG. 5. In some embodiments, however, one or both of the axes 78, 82 may be in a plane that is parallel to, but offset from, the plane 68. Although the axes 78 and 82 are shown as being coincident, they may be non-coincident in some embodiments.

Referring to FIG. 5, the first plate 60 includes a plurality of tube slots 86 to receivably engage the tubes 14*a*, 14*b*. The tube slots 86 are arranged in pairs, each pair corresponding to a tube 14*a*, a tube 14*b*, and a single flow conduit 70 to provide for fluid communication between the internal flow channels 56 of the tube 14*a* and the flow conduit 70 and between the internal flow channels 56 of the tube 14*b* and the flow conduit 70.

Edges 88 defined by the tube slots 86 are offset from the plane 68 so that a tube 14*a*, 14*b* can extend into a flow conduit 70 without substantially blocking the conduit 70. In order to provide for greater ease of insertion of the tubes 14*a*, 14*b* into the tube slots 86, a tapered lead-in 90 can be provided for each of the tube slots 86.

Figure 8:
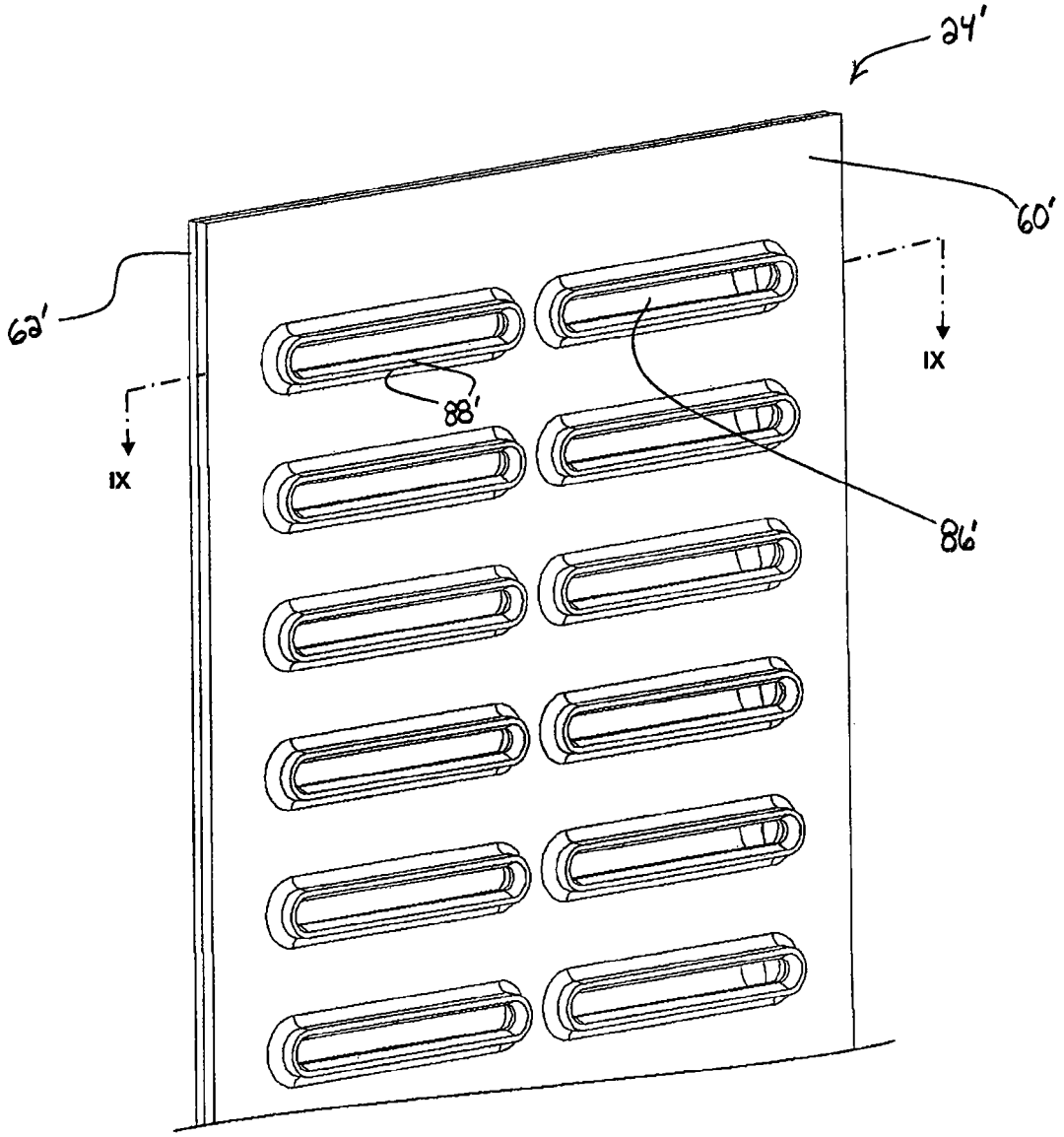
FIG. 8 is a partial perspective view of a header structure for use in another embodiment of the invention.
Figure 9:
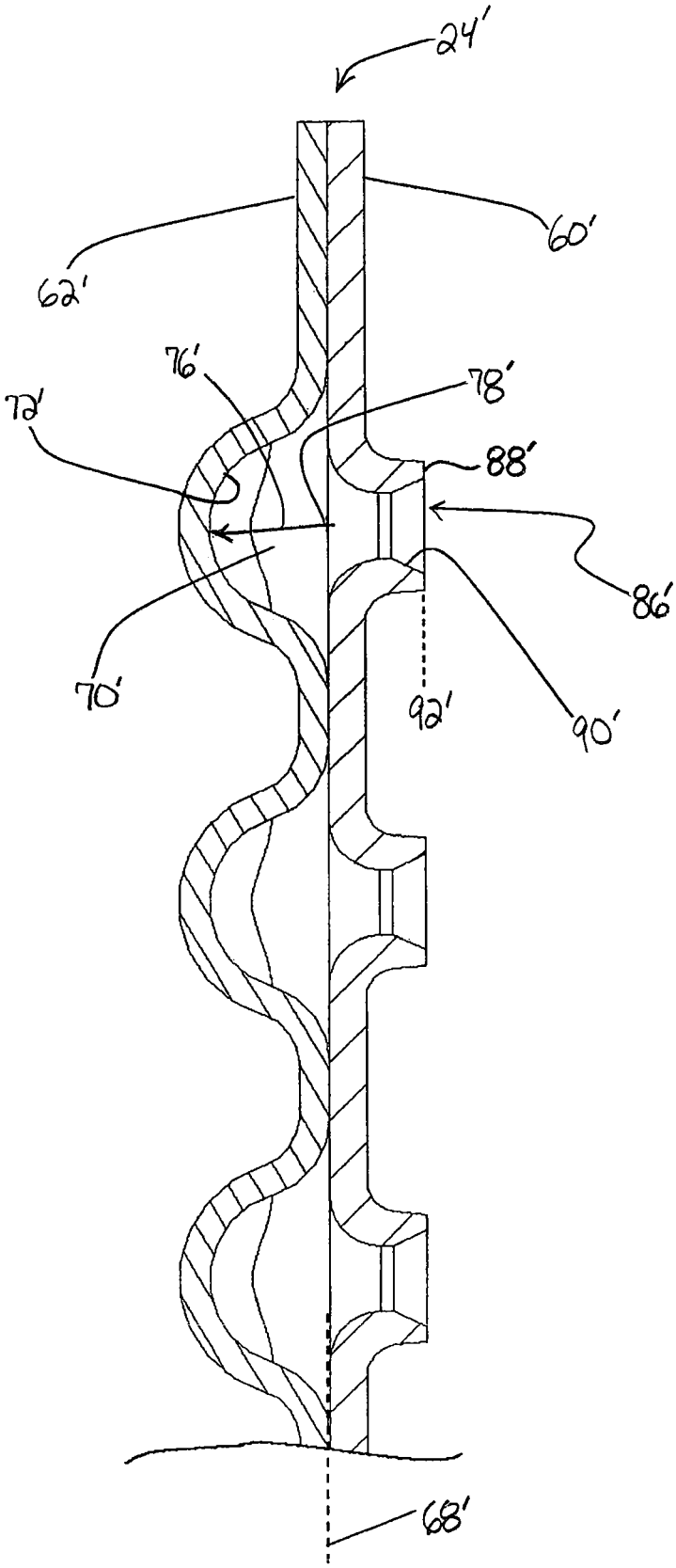
FIG. 9 is a sectional view along the lines IX-IX of FIG. 8.

FIGS. 8 and 9 illustrate an alternative embodiment of the return header 24 of FIGS. 1-7. The return header 24' illustrated in FIGS. 8 and 9 uses a modified plate 60' in place of the plate 60 found in the header structure 60 of FIGS. 1-7. The plate 60' does not include the arcuate recess 74 of the plate 60. In the embodiment of FIGS. 8 and 9, the edges 88' of the tube slots 86' are located in a common plane 92' that is parallel to and offset from the plane 68'. In this manner a tube 14*a*, 14*b*, could still be received in a tube slot 86' without substantially blocking the conduit 70'.

Figure 10:
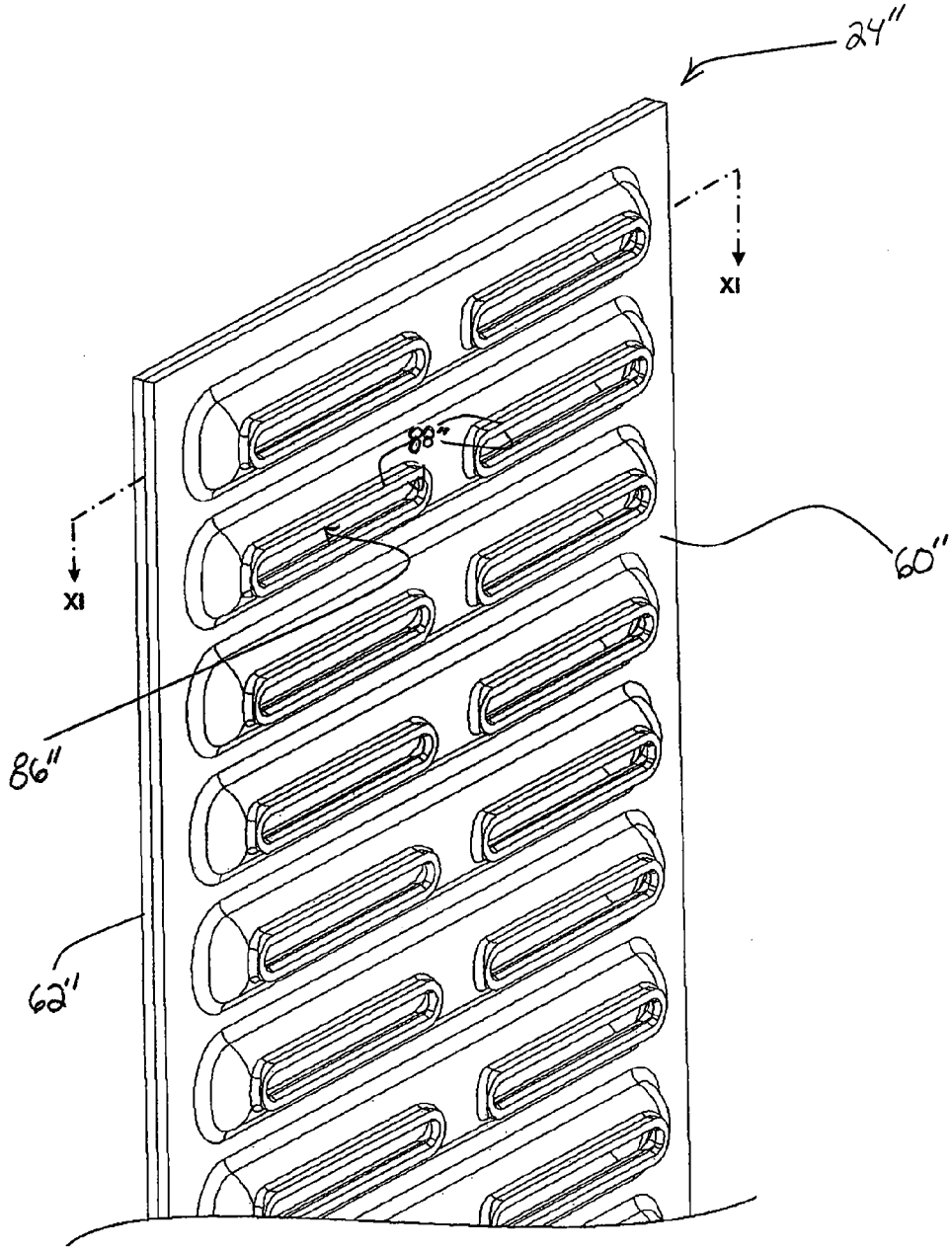
FIG. 10 is a partial perspective view of a header structure for use in another embodiment of the invention.
Figure 11:
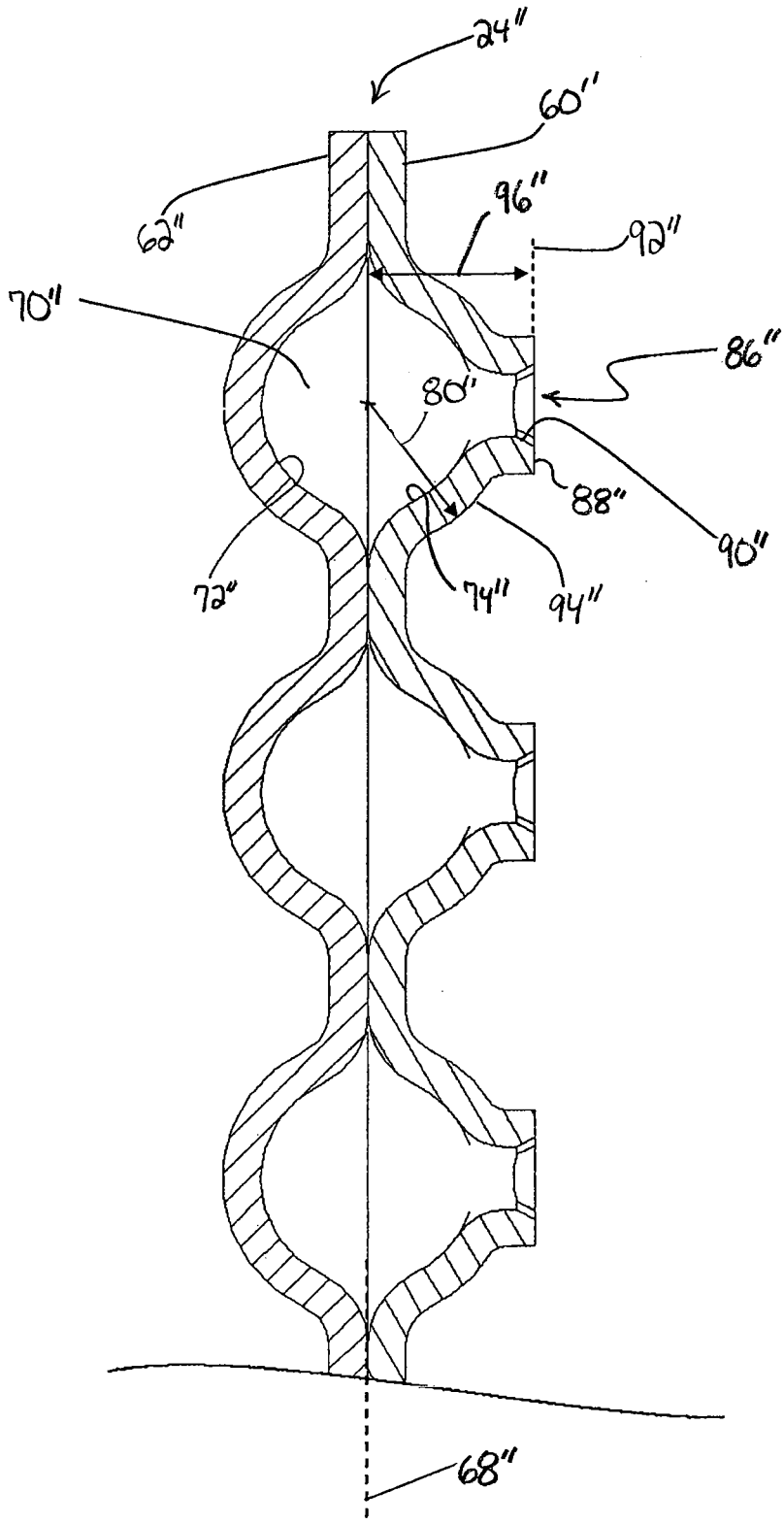
FIG. 11 is a sectional view along the lines XI-XI of FIG. 10.

FIGS. 10 and 11 illustrate yet another alternative embodiment of the return header 24 of FIGS. 1-7. The return header 24" of FIGS. 10 and 11 includes a plate 60" in place of the plate 60 of the header 24 of FIGS. 1-7. The plate 60" includes an arcuate recess 74" having a radius of curvature 80" measured to an outer surface 94" of the plate 60". The plate 60" also provides the common plane 92" for the edges 88" of the tube slots 86". In this embodiment the perpendicular distance 96" between the plane 68" and the plane 92" is greater than the radius of curvature 80" of the arcuate recess 74".

Figure 12:
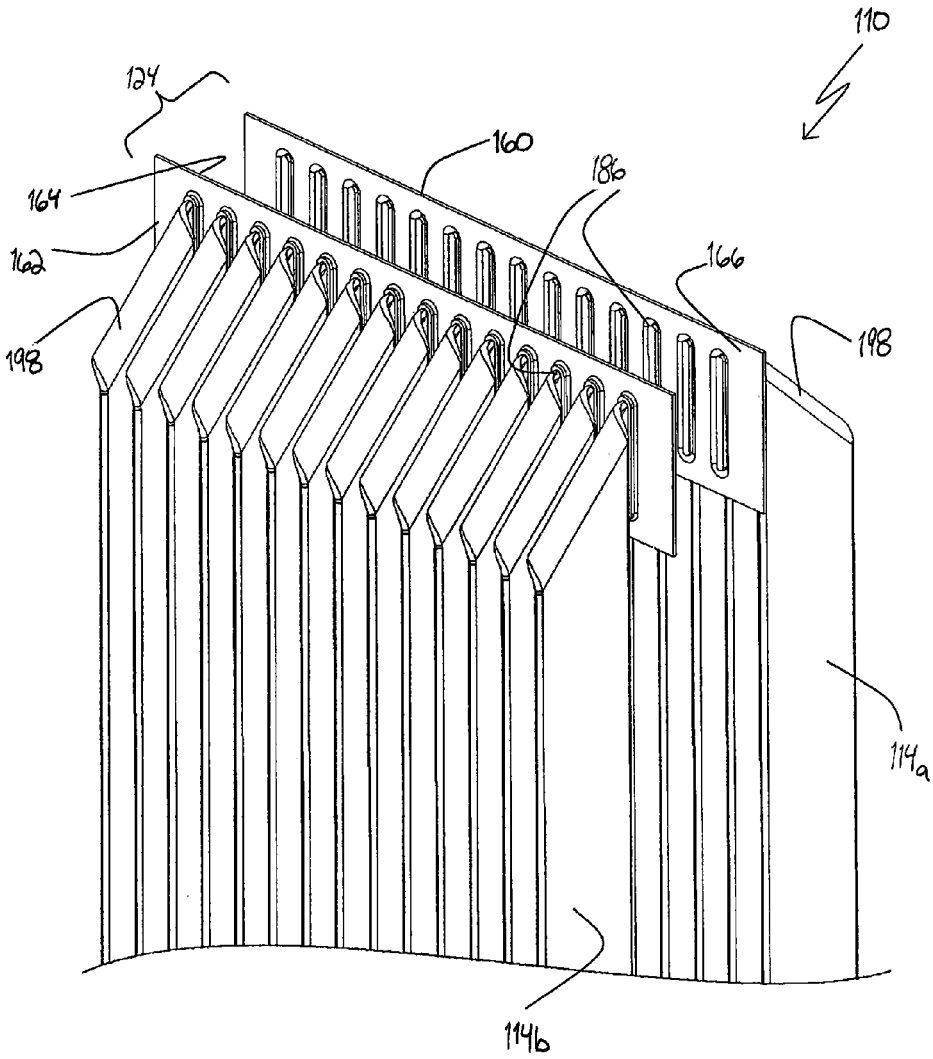
FIG. 12 is an exploded partial perspective view of a heat exchanger according to another embodiment of the invention.

A heat exchanger 110 according to another embodiment of the invention is illustrated in FIG. 12. The heat exchanger 110 includes a first flow pass comprising a first plurality of parallel arranged tubes 114*a*, and a second flow pass comprising a second plurality of parallel arranged tubes 114*b*. A header structure 124 fluidly connects the first flow pass to the second flow pass and comprises a first plate 160 and a second plate 162. A planar surface 164 of the plate 162 mates with a planar surface 166 of the plate 160. The plate 160 includes a first plurality of tube slots 186 corresponding to ends of the tubes 114*a* and the plate 162 similarly includes a second plurality of tube slots 186 corresponding to ends of the tubes 114*b*. Each of the tubes 114*a* and 114*b* include a 90 degree bend section 198 immediately adjacent to the header structure 124.

Various alternatives to certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A heat exchanger comprising:

a first header including an inlet of the heat exchanger;

a second header downstream from the first header;

a first tube defining a first flow pass, the first tube in fluid communication with the first header to receive a fluid from the first header, the first tube including first and second opposing flat broad sides joined by first and second opposing narrow sides;

a second tube defining a second flow pass in series with the first flow pass, the second tube in fluid communication with the second header to supply the fluid to the second header from the first tube;

a third header coupled to the first tube and the second tube to direct the fluid from the first tube to the second tube, the third header including, a first plate including a first generally planar face approximately perpendicular to the first and the second opposing flat broad sides of the first and the second tubes and a first arcuate recess that extends from the first planar face to at least partially define a flow conduit between the first tube and the second tube, a second plate including a second generally planar face parallel to the first planar face and coupled to the first planar face, the second plate including a second arcuate recess that extends from the second planar to at least partially define the flow conduit between the first tube and the second tube, wherein the first arcuate recess includes a first radius of curvature measured from a first axis generally parallel to the first planar face, wherein the second arcuate recess includes a second radius of curvature measured from a second axis generally parallel to the second planar face, wherein the first axis and the second axis are located within a first plane generally parallel to and midway between the first and the second opposing flat broad sides of the first tube and the second tube.

2. The heat exchanger of claim 1, wherein the first radius of curvature is approximately equal to the second radius of curvature.

3. The heat exchanger of claim 1, wherein the first axis is located within a second plane defined by the first planar face.

4. The heat exchanger of claim 3, wherein the second axis is located within a third plane defined by the second planar face.

5. The heat exchanger of claim 1, wherein the first axis is coincident with the second axis.

6. The heat exchanger of claim 1, wherein the first tube includes an outlet end, wherein the second tube includes an inlet end, wherein the first plate includes a first tube slot that receives the outlet end of the first tube and a second tube slot that receives the inlet end of the second tube, wherein the first tube slot includes an outer edge that defines an inlet of the first tube slot, wherein the second tube slot includes an outer edge that defines an outlet of the second tube slot, and wherein the outer edge of the first tube slot and the outer edge of the second tube slot are offset from the first planar face.

7. The heat exchanger of claim 6, wherein the first tube slot includes a tapered lead-in for assembly of the first tube therein, and wherein the second tube slot includes a tapered lead-in for assembly of the second tube therein.

8. The heat exchanger of claim 6, wherein the outer edge of the first tube slot and the outer edge of the second tube slot are offset from the first planar face by an amount greater than the first radius of curvature measured to an outer surface of the first plate.

9. The heat exchanger of claim 1, further comprising, a third tube in a parallel flow arrangement with the first tube to define the first flow pass, the third tube in fluid communication with the first header to receive fluid from the first header and in fluid communication with the third header to supply the fluid to the third header, a fourth tube in a parallel flow arrangement with the second tube to define the second flow pass, the fourth tube in fluid communication with the third header and the second header to transport the fluid from the third tube and the third header to the second header, wherein the first planar face and the second planar face are coupled such that fluid communication is generally prohibited between the first tube and the third tube at the third header.

10. The heat exchanger of claim 1, wherein the first planar face is directly joined to the second planar face.

11. The heat exchanger of claim 1, wherein the third header is located at a first end of the heat exchanger, and wherein the first header and the second header are located at a second end of the heat exchanger opposite the first end.

12. The heat exchanger of claim 11, wherein the first header is adjacent the second header at the second end of the heat exchanger.

13. The heat exchanger of claim 12, wherein the second header includes an outlet of the heat exchanger.

14. The heat exchanger of claim 13, wherein the inlet of the heat exchanger is adjacent to the outlet of the heat exchanger.

* * * * *